US007017911B1

(12) United States Patent
Chia

(10) Patent No.: US 7,017,911 B1
(45) Date of Patent: Mar. 28, 2006

(54) REMOTELY CONTROLLED UNDERWATER RETRIEVAL GAME

(76) Inventor: Francis See Chong Chia, 17 Kadoorie Ave, Kowloon, Hong Kong, Hong Kong (CN)

( * ) Notice: Subject to any disclaimer, the term of this patent is extended or adjusted under 35 U.S.C. 154(b) by 0 days.

(21) Appl. No.: 11/015,861

(22) Filed: Dec. 20, 2004

Related U.S. Application Data

(60) Provisional application No. 60/632,189, filed on Dec. 1, 2004.

(51) Int. Cl.
*A63F 9/30* (2006.01)

(52) U.S. Cl. ..... 273/442; 273/459; 273/447

(58) Field of Classification Search ..... 273/442, 273/445, 454, 457, 459–461, 440, 441, 447, 273/448; 446/153, 154, 156, 161, 454, 456; 463/39

See application file for complete search history.

(56) References Cited

U.S. PATENT DOCUMENTS 2,779,131 A * 1/1957 Scheithauer ..... 446/155
3,722,135 A * 3/1973 Jacobson ..... 446/425
4,010,619 A * 3/1977 Hightower et al. ..... 405/191
4,938,483 A * 7/1990 Yavetz ..... 463/5
5,597,165 A * 1/1997 Rundle et al. ..... 273/442
5,810,364 A * 9/1998 Canion ..... 273/459
6,165,036 A * 12/2000 Hino et al. ..... 446/154
6,238,265 B1 * 5/2001 Crane et al. ..... 446/456
6,491,566 B1 * 12/2002 Peters et al. ..... 446/454

* cited by examiner

*Primary Examiner*—Raleigh W. Chiu
(74) *Attorney, Agent, or Firm*—Frank Marino

(57) ABSTRACT

A game comprising a submersible retrieving submarine adapted to receive and interpret RF directional command signals, an RF transmitting remote controller adapted for sending such signals to cause the craft to submerge and then cause the submerged craft to move in selected underwater directions, and targets of assigned values adapted for standing on the underwater bottom. The craft is adapted with a hook for engaging the targets and carrying them to the water's surface so that the accumulated value of the collected targets can be tallied to provide a score. One or more players can compete to tally the highest score, using either one controller/submarine set consecutively, or two sets simultaneously.

16 Claims, 3 Drawing Sheets

100
104
114
112
126
110
102
122
156
124
134
136
106C
30
154
134
120
110
136
132
106 A
20
136
134
106B
140

REMOTELY CONTROLLED UNDERWATER RETRIEVAL GAME

This Application is a formalization of U.S. Provisional Application Ser. No. 60/632,189 filed Dec. 1, 2004.

FIELD OF THE INVENTION

This invention relates to a remotely controlled underwater retrieval game. More particularly, the present invention relates to a game having a robotic toy that is controlled by a radio transmitter to collect targets from underwater, such as in a swimming pool.

BACKGROUND AND OBJECTS OF THE INVENTION

Remotely controlled devices for retrieving underwater objects are well known. Miniature submarines, controlled remotely from an above-surface station, have been employed for some time by entities such as the Navy or private salvage companies to retrieve objects that have fallen to the seabed. U.S. Pat. No. 6,601,333 discloses a remotely controlled retrieval device in the form of a duck, which can be caused to travel about the surface of a lake or pond to an area where a shot game animal has fallen, and which is equipped with a hooking device to engage and retrieve the game animal to the hunter.

It is a primary object of the present invention to provide a game in which submerged objects may be skillfully retrieved from above the water by such a remotely controlled underwater retriever.

It is a further object to provide such a game in which various of the submerged objects are assigned various score values, and the player's game score is tallied according to the sum of values of the retrieved objects.

It is a further object to configure the objects and retriever such that a plurality of objects may be accumulated, and the retriever may carry that plurality simultaneously.

It is a further object to provide such a game in which two or more players can participate, either by alternately collecting objects with the same retriever, or by the use of different retrievers, each individually controlled by each player.

It is a further object to provide such a game in which the variously submerged objects have upwardly projecting loops for receiving a hooking means of the retriever and the objects are weighted at their bases and buoyed at their tops so that the objects automatically assume a standing position on the underwater floor, whereby the loops are automatically positioned for reception of the hooking means.

It is a further object to provide a method for playing such a game in which the players compete alone or against one another according to the total score of all of their retrieved objects.

Further objects and advantages of the invention will become apparent in view of the following disclosure thereof.

SUMMARY OF THE INVENTION

In accordance with the preferred embodiment of the invention, a remotely controllable submarine craft is provided, comprising battery-powered means for propelling the craft underwater in any direction; right or left, forward or backward, and up or down. The craft is slightly positively buoyant, with weighting near to its bottom and floatation near to its top to keep the craft always oriented in an upright position and cause it to float slowly towards the surface and then float at the surface when it is not energized downwardly. The body portion of the craft comprises a hook, projecting forwardly from its underside. The body portion of the craft contains battery-powered electrical circuitry, which includes a receiver for accepting RF motion commands and means to convert those commands into electrical signals to the propelling means.

A plurality of figurines is also provided, to be used as targets for collection by the submarine. Each figurine is slightly negatively buoyant, with weighting at its base and floatation near to its top so that, when dropped into the water, it will sink slowly to the bottom surface and assume a standing position. Each figurine comprises an upwardly projecting loop having a hole there-through, which is adapted to receive the hook of the submarine. Each Figurine bears a particular score value. Each figurine may be colored according to its value so that the player can distinguish the figures from above the water surface. The size of the hole in a figurine's loop may be inversely proportional to its value, with higher valued figurines having smaller holes to make them more difficult to retrieve. The hook of the submarine may include a barb so that figurines are less apt to accidentally fall off once they have been captured, or may have no barb, increasing the skill that is required to avoid such an accident.

An RF transmitting remote control is additionally provided, which is held by the game player above the water surface. The transmitter includes control means for selecting desired movements of the submarine and means for sending the aforementioned commands according to such selections. The control may take the form of a joystick or directional arrow-shaped push-button switches. A Timer may be incorporated in the circuitry of either the joystick of the submarine so that the player's time for collecting targets can be monitored or limited. For instance, the timer may cause the transmitter to stop sending signals to the submarine so that the submarine floats to the surface after an allotted amount of time has expired. Or the timer might simply cause an audible signal after the allot time has passed. Alternatively, the timer may simply be a clock to track the amount of time that it takes until all of the targets have been retrieved.

It is further anticipated that the game may include a plurality of submarine/transmitter pairs for use by a plurality of competing players.

In use, a player first drops the target figurines into the water, such as into a swimming pool. Because the figurines are slightly negatively buoyant, they sink slowly to the bottom. Because their bases are more heavily weighted, they assume an upright position as they descend and settle to the bottom in a standing position with their loops aiming upwardly. Preferably, the figurines are scattered randomly about the bottom surface of the pool.

The player then turns the retriever submarine on, and places it into the pool. Absent any motion commands, the submarine will float, partially submerged, at the water surface.

The player then turns on the remote control transmitter. By actuating the control, desired motion commands are sent out in the form of RF signals. Upon receipt of these signals by the submarine's receiving circuitry, the submarine moves in the desired direction within the water; forward/descend, left, right or backward. An upward motion is achieved by pausing the commands. The player thus directs the submarine towards a first selected target figurine, aiming to cause the hook which projects from the submarines underside to pass through the loop of the intended figurine. The target is thus "collected". The player then directs the submarine towards the next selected target figurine and repeats this process until either all of the targets have been collected or the allotted time has expired.

In one embodiment of the game, retrieval activities are terminated at the expiration of the allotted time and the player tally's his score by totaling the values of the targets captured on the hook. The player collecting the highest total target value is the winner.

In another embodiment of the game, the game proceeds until all targets are collected, regardless of their values, and the player who has collected all targets in the least amount of time is the winner.

In still another embodiment of the game, two players simultaneously operate two individual submarines, which each operate at a different RF frequency, to see who can collect the most targets or most total value of targets.

Further applications of the game and more specific advantages and features of the invention may become obvious to those of ordinary skill in game-playing upon perusal of the following detailed description of the preferred embodiment of the invention, taken in conjunction with the accompanying drawings.

DETAILED DESCRIPTION OF THE PREFERRED EMBODIMENT

Figure 1:
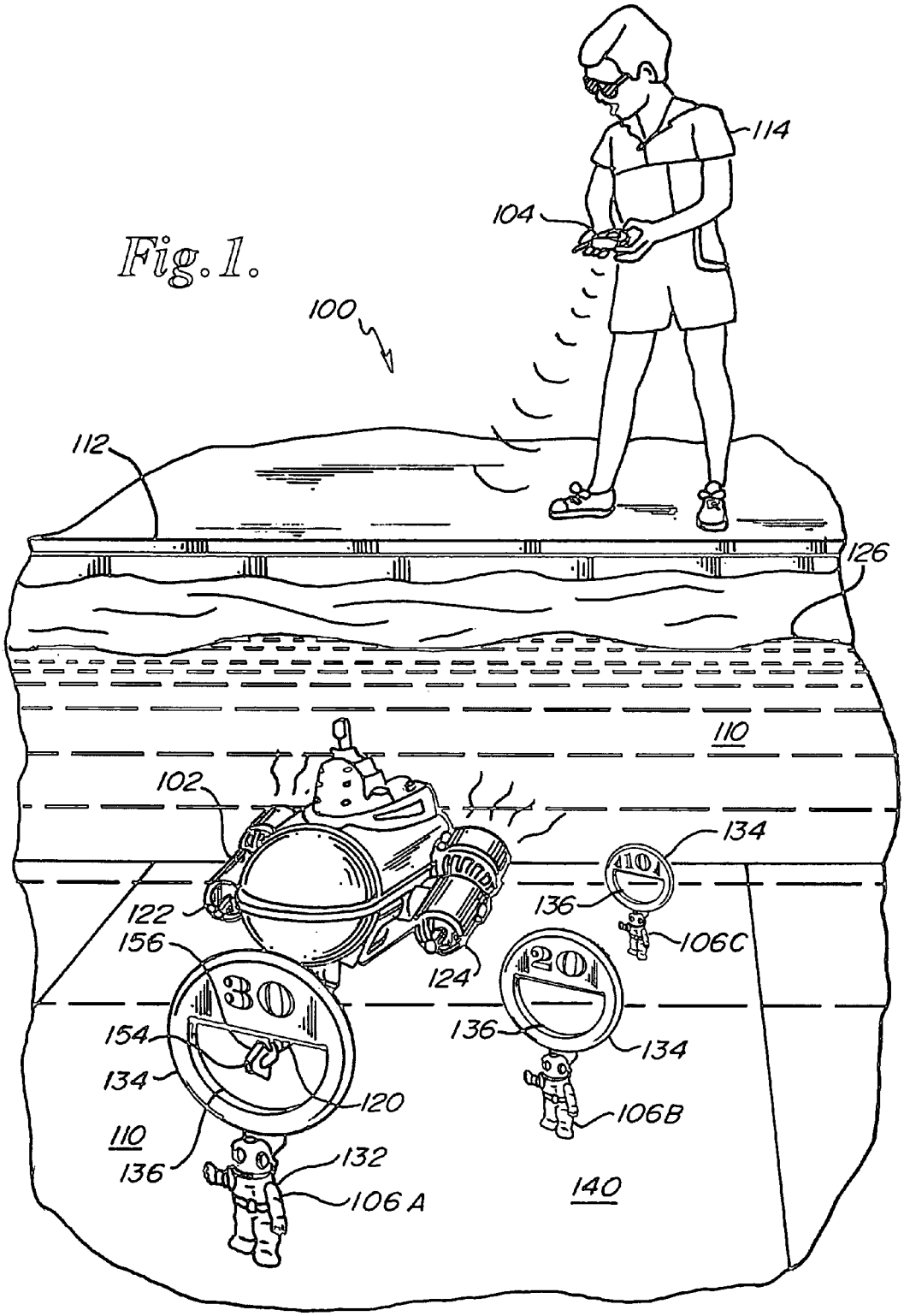
FIG. 1 is a perspective view of a retrieval game according to the preferred embodiment of the invention, being played in a swimming pool.

Turning now to the drawings, in which like reference characters indicate corresponding elements throughout the several views, there is shown a remotely controlled game 100 in accordance with the preferred embodiment of the invention having an RF-receiving retriever submarine 102, an RF transmitting controller 104, and several target figurines 106A through 106C. In FIG. 1, a view is provided during the playing of the game in which the submarine 102 and targets 106A, 106B and 106C, have already been placed into the water 110 of a swimming pool 112, and a player 114 holds the controller 104 and sends commands to the submarine 102.

The submarine 102 comprises a body 116 having a hook 120 extending downwardly and forwardly from its underbelly. Additionally, the submarine is equipped with a right turbine 122 and a left turbine 124 for providing propulsion in the water. The turbines can be selectively and variably energized for forward or rearward propulsion by battery-powered electrical circuitry contained within body 116. That circuitry (not shown) also includes means for receiving RF signals from the controller and converting those signals into electrical currents to the turbines. Such circuitry and transmission means are well known in the prior art and the present invention is not dependent on the use of any particular circuitry or transmission means. For instance, in a less preferred embodiment, the submarine and controller could be connected by a long electrical cable and still function within the scope of the invention. Or the signals could be of another type, other than RF, such as IR or audible signals. Or the converted electrical currents could drive some other form or propulsion, such as the swimming tail and fins of a toy creature. All of these alternate embodiments, although less preferred at the present time, still fall within the scope of the present invention.

The submarine and its internal components all together have a weight and density that render it slightly positively buoyant, so that it naturally tends to float partially submerged at the water surface 126 when the turbines are not active. In the preferred embodiment, this buoyancy is achieved by including an air-filled blow molding in the submarine's tower 128, and positioning the heavier-than-water internal components that are within the submarine below the intended water line. In this dormant state, only the submarine's tower 128 extends above the water surface 126, as is typical of a real submarine. This allows the player to see the submarine when it is at the surface, to turn it on or off, and makes retrieval of the submarine easy when the game is done. This also has the added benefit that, should the submarine move outside of the controller's transmitting range, or should the submarine's batteries die, the submarine will simply float to the water surface for easy retrieval.

Figure 2:
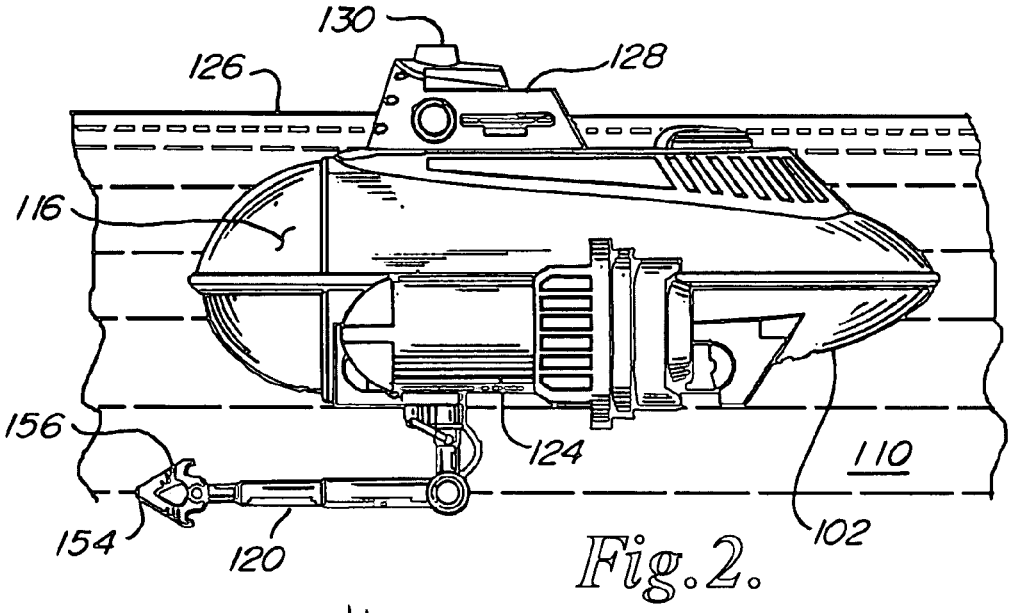
FIG. 2 is an elevation view of the retrieval submarine of the game of FIG. 1, shown at rest at the surface of the water.
Figure 3:
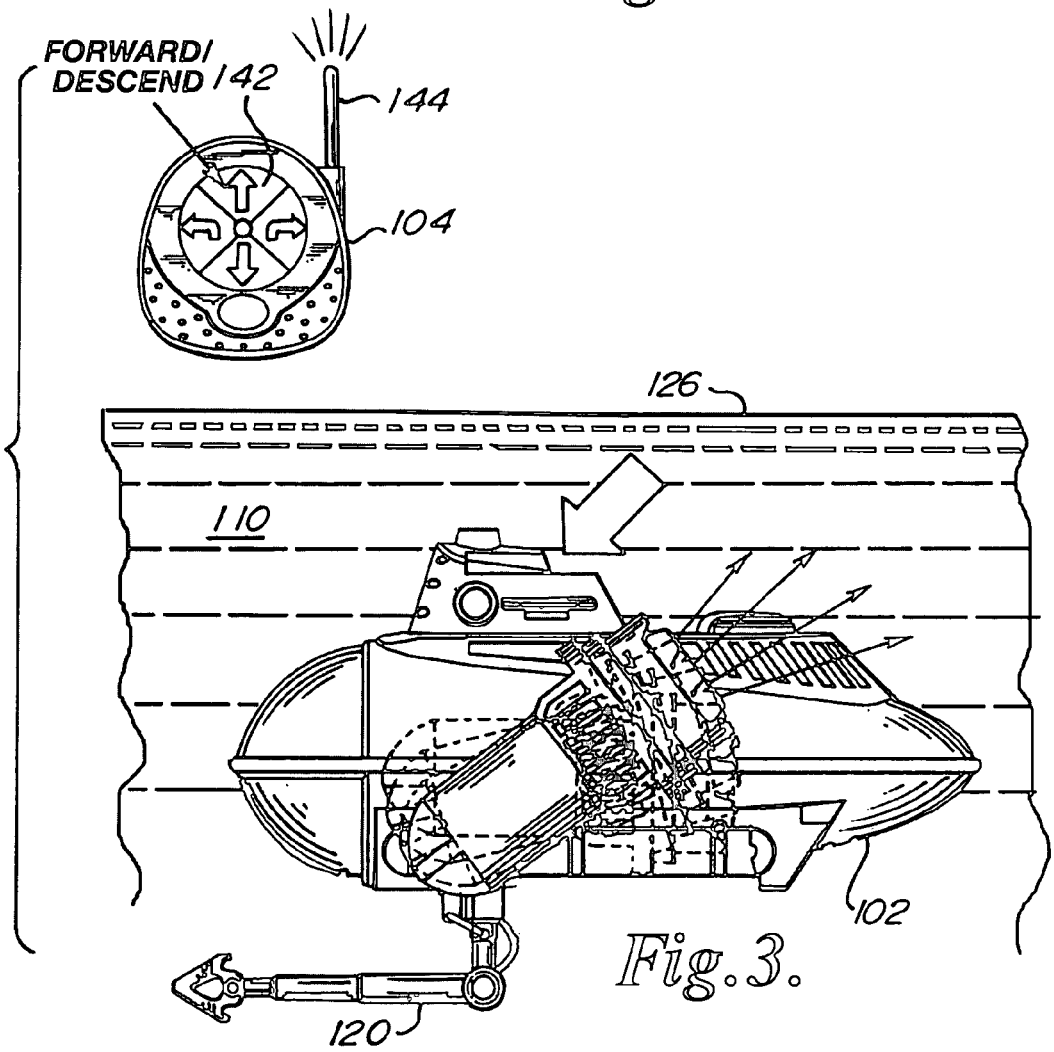
FIG. 3 is an elevation view of the controller and submarine of FIG. 1, demonstrating the performance and result of a "forward/descend" command.

As shown in FIGS. 2 and 3, the turbines 122 and 124 are manually pivotable into a variety of desired downward directions by the player prior to placing the submarine in the water. The degree to which they are pivoted effects the speed and forward angle at which the submarine 102 descends when commanded to do so, and effects turning ability of the submarine upon left and right commands, but is a matter of each player's personal preference and skill. There are four distinct downward positions selectable by the player in the preferred embodiment. Initially, prior to the playing of the game as it is depicted in FIG. 1, the player manually selects the downward position with which he is has become most comfortable and skillful, and positions the turbines accordingly, then places the submarine in the water 110.

The submarine 102 is energized by manually depressing button 130 on the tower 128, which activates the circuitry and enables it to receive command signals.

The target figurines 106A, 106B and 106C are preferably configured to represent deep sea divers, but might take any applicable form, such as pieces of treasure or some other articles of value, or anything in need of being saved or retrieved. Each Figurine is comprised of a base portion 132, which is preferably made of or includes PVC, selected for its negative buoyancy. In the preferred embodiment, the base portion is the portion shaped as a deep-sea diver. At the top of each figurine is a loop 134, preferably comprised of a hollow ABS shell, having a hole 136 there-through. The hole is sufficient in size and shape to accept the hook 120 of the submarine 102, thereby being captured. The loop may be air-filled or include a donut-shaped float (not shown), made of an air-filled blow-molding or Styrofoam or the like, to provide positive buoyancy only at the top of the figurine, such positive buoyancy being insufficient to overcome the negative buoyancy of the body portion 132 and therefore insufficient to make the target float, but sufficient to cause only the upper portion of the target to rise. It is therefore a feature of the figurines that its total slight negative buoyancy causes the figurine to slowly sink in the water 110 to the pool's bottom surface 140, and the heavier lower body portion 132 and lighter upper loop portion 134 together cause the figurine to assume a standing position on the bottom surface 140, so that the loop 134 and its hole 136 are positioned for easier retrieval by the submarine's hook 120. In an alternative configuration, the loop portion could be disposed at the bottom of the target and the body portion could be disposed at the top, with the loop portion would be made of the heavier material and the body portion would include floatation.

It should also be obvious that the hook 120 of the submarine could be replaced with some other form of extension and the hole 136 of the target could be replaced with some other form of accepting feature, so long as the extension is capable to serve as a collecting feature, and the accepting feature is adapted to accept and be collected by that collecting feature.

Figure 4A:
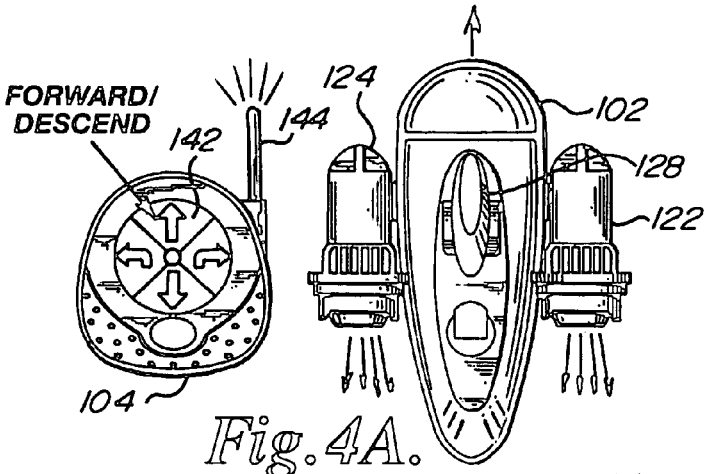
FIG. 4A is a plan view of the controller and submarine of FIG. 1, demonstrating the performance and result of a "forward/descend" command.

Turning again to FIG. 3 and also to FIG. 4A, it is shown that when the "forward/descend" button 142 on the controller 104 is pressed, a "forward/descend" command is transmitted from the controller's antenna 144, which is received by a corresponding antenna (not shown) in the submarine's tower 128, which command is converted into equal electrical currents to both turbines 122 and 124. This causes the downwardly positioned turbines to propel the submarine down into the depths of the pool in a straight and forward direction.

Figure 4B:
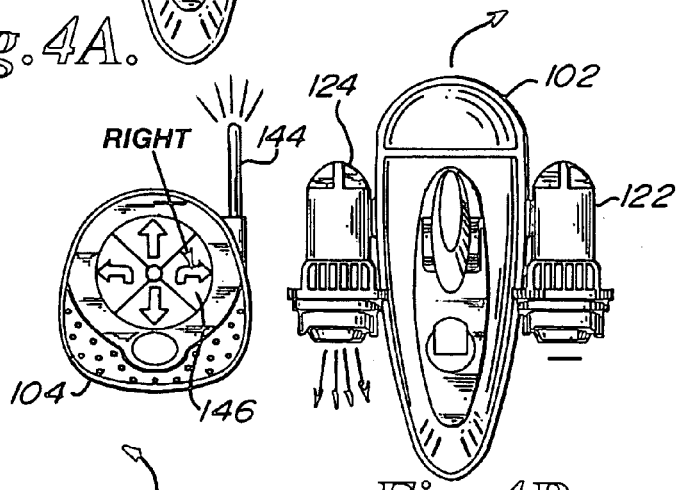
FIG. 4B is a plan view of the controller and submarine of FIG. 1, demonstrating the performance and result of a "right" command.

Turning now to FIG. 4B, it is shown that when the "right" button 146 is pressed, a "right" command is transmitted, which instead causes a current to be sent to propel the submarine in a rightward direction.

Figure 4C:
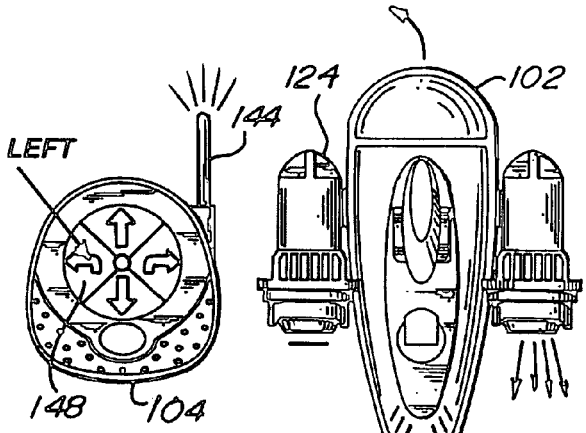
FIG. 4C is a plan view of the controller and submarine of FIG. 1, demonstrating the performance and result of a "left" command.

Turning now to FIG. 4C, it is shown that when the "left" button 148 is pressed, a "left" command is transmitted, which instead causes a current to be sent to propel the submarine in a leftward direction.

Figure 4D:
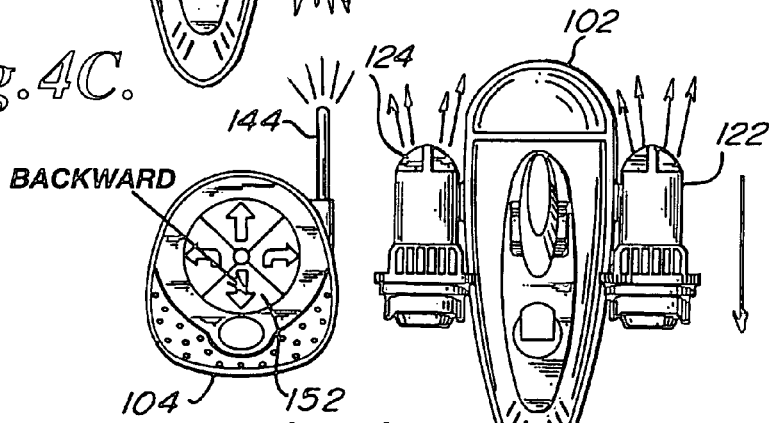
FIG. 4D is a plan view of the controller and submarine of FIG. 1, demonstrating the performance and result of a "backward" command.

Finally, turning to FIG. 4D, it is shown that when the "backward" button 152 is pressed, a "reverse" command is transmitted, which causes a reverse current to be sent to both turbines, causing them both to equally spin backwards and propel the submarine in a backwards direction.

A unique feature of the circuitry is that each submarine is pre-tuned to recognize only signals of a certain frequency, and that controllers are available for transmitting in that particular frequency. In the preferred embodiment, controller/submarine sets are available in either 27 MHz or 49 MHz. Two players can thereby operate their submarines simultaneously without interference.

An additionally feature of the controller is that it is made positively buoyant, so that it will float at the water surface if accidentally dropped into the pool. This not only makes it easier to retrieve, but also avoids water damage. Because the controller includes batteries and electronic circuitry, it is housed in a watertight manner. But the higher pressure that exists at the depths of the pool could inadvertently force water into the housing and cause damage. The buoyancy of the controller avoids this potential problem.

To play the game, directional commands are sent to the submarine, aiming the tip 154 of its hook 120 toward the hole 136 of a selected target, in an attempt to thread the hook through the hole and collect the target, then proceeds to do the same to the next selected target. In the preferred embodiment, the tip 154 includes a barb 156, to keep collected targets from accidentally falling off of the hook after they have been collected, such as might otherwise occur when the submarine is driven backwards or as it floats to the surface. It should be obvious that the barb 156 shown could take numerous alternative forms, so long as the purpose of keeping a captured target from accidentally falling off of the hook is accomplished.

Variations of the game, as previously described, may then be played by one or more players.

The invention has been described above with respect to the preferred embodiment; however, other changes and modifications may be made which are still contemplated and within the spirit and scope of the invention. The invention should therefore only be limited according to the following claims.

I claim:

1. A game comprising a submersible retrieving craft, a remote controller adapted for causing said craft to submerge in water and for then causing the submerged craft to move in selectable underwater directions, and targets of assigned values, said craft being adapted with means for engaging said targets and carrying said targets to the water's surface so that an accumulated value of said collected targets can be tallied to provide a score, and wherein one or more players can compete to tally a highest score.

2. The game of claim 1, wherein each of said targets includes an accepting feature, and said means for engaging said targets is an extension from said craft, which extension is adapted to mate with said accepting feature.

3. The game of claim 2, wherein said accepting feature is a hole positioned adjacent to the top of said target, and said extension is a hook extending forwardly from said craft.

4. The game of claim 3, wherein said hook includes a barb for retaining said target thereon after said target has been engaged.

5. The game of claim 1, wherein said craft is a submarine adapted to receive and interpret wireless signals, and said controller is a wireless signal transmitter adapted to send various directional signals to said submarine.

6. The game of claim 5, wherein said submarine is adapted to return to the surface of the water when no wireless signals are received.

7. The game of claim 6, wherein said submarine is so adapted to return to the surface of the water by being positively buoyant.

8. The game of claim 7, wherein each of said targets includes a hole positioned adjacent to the top of said target, and said means for engaging said targets is an extension from said craft which is adapted to mate with said hole.

9. The game of claim 8, wherein said extension is a hook extending forwardly from said craft.

10. The game of claim 9, wherein said hook includes a barb for retaining said target thereon after it has been engaged.

11. The game of claim 5, wherein said wireless signals are RF waves.

12. The game of claim 11, wherein said wireless RF waves are transmitted and received at a first given frequency, and further including a second such controller adapted to transmit RF signals of a second given frequency, and further including a second such submarine adapted to receive said RF signals of said second given frequency, so that both of said controllers and both of said submarines can be operated simultaneously without signal interference.

13. A method for playing an underwater retrieval game including; sending directional movement commands from a remote controller to a submerged retrieving craft which is adapted to engage and capture underwater targets, each target having an assigned value, causing said craft to bring said captured targets to the surface of the water, tallying accumulated values of said captured targets to create a score.

14. The method of claim 13 further including monitoring an elapsed time taken to capture a given quantity of said targets.

15. The method of claim 13, wherein said sending, causing and tallying are done by a first player, and wherein a second player so sends signals from a second remote controller to a second craft and causes said second craft to bring said second craft's captured targets to the surface of the water, and wherein each player tallies his respective score according to accumulated values of his submarine's captured targets to establish a winning player according to that player whose submarine has accumulated the highest score.

16. The method of claim 13, wherein said sending, causing and tallying are done by a first player, and wherein a second player so sends signals from a second remote controller to a second craft and causes said second craft to bring said second craft's captured targets to the surface of the water, and further including monitoring an elapsed time taken by each player to capture a given quantity of targets to establish a winning player according to that player whose submarine has captured said given number in the least amount of elapsed time.

* * * * *